US010611114B2

(12) United States Patent
Dobashi

(10) Patent No.: US 10,611,114 B2
(45) Date of Patent: Apr. 7, 2020

(54) FRAME STRUCTURE, PROCESSING APPARATUS, METHOD OF MANUFACTURING COMPONENTS, METHOD OF MANUFACTURING ROLLING BEARING, METHOD OF MANUFACTURING VEHICLE, METHOD OF MANUFACTURING MACHINE AND PRESS APPARATUS

(71) Applicant: NSK LTD., Tokyo (JP)

(72) Inventor: Kouhei Dobashi, Fujisawa (JP)

(73) Assignee: NSK LTD., Tokyo (JP)

( * ) Notice: Subject to any disclaimer, the term of this patent is extended or adjusted under 35 U.S.C. 154(b) by 0 days.

(21) Appl. No.: 16/087,927

(22) PCT Filed: Aug. 30, 2017

(86) PCT No.: PCT/JP2017/031129
§ 371 (c)(1),
(2) Date: Sep. 24, 2018

(87) PCT Pub. No.: WO2018/142654
PCT Pub. Date: Aug. 9, 2018

(65) Prior Publication Data

US 2019/0084263 A1 Mar. 21, 2019

(30) Foreign Application Priority Data

Feb. 6, 2017 (JP) ..... 2017-019364

(51) Int. Cl.
*B30B 15/04* (2006.01)
*B21D 5/02* (2006.01)
*B21J 13/04* (2006.01)

(52) U.S. Cl.
CPC ..... *B30B 15/044* (2013.01); *B21D 5/0272* (2013.01); *B21J 13/04* (2013.01); *B30B 15/047* (2013.01)

(58) Field of Classification Search
CPC ..... B30B 15/04; B30B 15/044; B30B 15/047; B21J 15/10; B21J 13/04; B21D 5/02
(Continued)

(56) References Cited

U.S. PATENT DOCUMENTS 4,951,495 A * 8/1990 Van Daalen ..... B30B 15/047 100/231
5,062,290 A * 11/1991 Hoover ..... H01R 43/0427 100/231
(Continued)

FOREIGN PATENT DOCUMENTS

JP 59-16800 U 2/1984
JP 62-033100 A 2/1987
(Continued)

OTHER PUBLICATIONS

International Search Report for PCT/JP2017/031129 dated Oct. 24, 2017 [PCT/ISA/210].

*Primary Examiner* — Jimmy T Nguyen
(74) *Attorney, Agent, or Firm* — Sughrue Mion, PLLC

(57) ABSTRACT

A frame structure includes a C-shaped frame having a front side that opens in a forward and rearward direction among the forward and rearward direction, a leftward and rightward direction and an upward and downward direction, which are perpendicular to each other, an upper action section supported by an upper front portion of the C-shaped frame, and a lower action section supported by a lower front portion of the C-shaped frame, wherein, when a reaction force is applied through the upper action section, the C-shaped frame is deformed such that a displacement of the upper action section in the forward and rearward direction, which occurs according to an elastic deformation of the C-shaped frame, is canceled out and such that a displacement of a
(Continued)

pivotal movement about a leftward and rightward direction axis of the upper action section is canceled out.

31 Claims, 5 Drawing Sheets

(58) Field of Classification Search
USPC ..... 100/231; 72/455
See application file for complete search history.

(56) References Cited

U.S. PATENT DOCUMENTS

| | | | | |
|---|---|---|---|---|
| 5,633,024 | A | 5/1997 | Ziv-Av | |
| 5,783,231 | A * | 7/1998 | Fuller | B29C 45/1761 100/231 |
| 6,072,583 | A * | 6/2000 | Kellner | B21J 15/10 227/119 |
| 2005/0132563 | A1 * | 6/2005 | Schmidt | B21D 39/031 29/715 |
| 2016/0263940 | A1 | 9/2016 | Hagiwara | |

FOREIGN PATENT DOCUMENTS

| | | | |
|---|---|---|---|
| JP | 2001-025900 | A | 1/2001 |
| JP | 2015-077616 | A | 4/2015 |

* cited by examiner

FRAME STRUCTURE, PROCESSING APPARATUS, METHOD OF MANUFACTURING COMPONENTS, METHOD OF MANUFACTURING ROLLING BEARING, METHOD OF MANUFACTURING VEHICLE, METHOD OF MANUFACTURING MACHINE AND PRESS APPARATUS

This application is a National Stage of International Application No. PCT/JP2017/031129, filed on Aug. 30, 2017, which claims priority from Japanese Patent Application No. 2017-019364, filed Feb. 6, 2017, the contents of all of which are incorporated herein by reference.

TECHNICAL FIELD

The present invention relates a frame structure having a C-shaped frame structure, a processing apparatus, a method of manufacturing components, a method of manufacturing a rolling bearing, a method of manufacturing a vehicle, a method of manufacturing a machine and a press apparatus.

BACKGROUND ART

A frame structure of a press apparatus (a press machine) is generally classified as a C type or a portal type from a shape thereof. A press apparatus having a C-shaped frame structure is widely used because workability from a front surface is good in comparison with a press apparatus having a portal frame structure.

FIG. 4 shows an example of a conventional structure of a press apparatus having such a C-shaped frame structure.

A press apparatus 1 shown in FIG. 4 includes a C-shaped frame 2, a fixed die 3 and a movable die 4.

The C-shaped frame 2 is configured by combining a lower frame 5, an intermediate frame 6 and an upper frame 7 in a C shape in which a front side in a forward and rearward direction and both sides in a leftward and rightward direction are open.

Further, among "a forward and rearward direction," "a leftward and rightward direction" and "an upward and downward direction," which are perpendicular to each other in the press apparatus, "the forward and rearward direction" is a leftward and rightward direction in the drawings, "the leftward and rightward direction" is a direction perpendicular to surfaces of the drawings, i.e., a front and back sides of the drawings, and "the upward and downward direction" is an upward and downward direction in the drawings. In addition, "a front side" of "the forward and rearward direction" is a right side in the drawings, and "a rear side" of "the forward and rearward direction" is a left side in the drawings.

The fixed die 3 is supported by and fixed to an upper surface of the lower frame 5.

The movable die 4 is supported movably with respect to the upper frame 7 in the upward and downward direction while being disposed above the fixed die 3. For this reason, specifically, the movable die 4 is supported movably in the upward and downward direction by a hydraulic or electrically-operated cylinder (not shown) assembled on the upper frame 7.

When pressing of a workpiece is performed using the press apparatus 1 having the above-mentioned configuration, for example, in a state in which the movable die 4 is retracted upward from the fixed die 3 and the workpiece is set on the fixed die 3 or the movable die 4, the movable die 4 is moved downward toward the fixed die 3. Accordingly, predetermined pressing such as shearing, bending, drawing, forging, or the like, is performed on the workpiece between the fixed die 3 and the movable die 4.

CITATION LIST

Patent Literature

[Patent Literature 1]
Japanese Unexamined Patent Application, First Publication No. 2001-25900

SUMMARY OF INVENTION

Technical Problem

Incidentally, when pressing of the workpiece is performed using the press apparatus 1 in this way, a processing reaction force F from the workpiece is applied to the C-shaped frame 2 via the fixed die 3 and the movable die 4 (and the cylinder). Accordingly, elastic deformation that is referred to as opening shown by an alternating two dots-dash line in FIG. 5 occurs in the C-shaped frame 2. Then, accordingly, axis displacement that is referred to as relative displacement between the fixed die 3 and the movable die 4 in the forward and rearward direction or inclination of central axes of the fixed die 3 and the movable die 4 occurs between the fixed die 3 and the movable die 4. For this reason, it is difficult to secure processing accuracy of the workpiece unless some countermeasures are taken against the elastic deformation of the opening of the C-shaped frame 2 as described above.

Here, in the related art, in order to minimize the elastic deformation of the opening of the C-shaped frame as described above, a countermeasure of increasing a thickness of the C-shaped frame and increasing rigidity thereof was taken.

However, in order to respond to a demand of miniaturization or cost reduction generally imposed on a mechanical apparatus, there is a certain limit on increasing the thickness of the C-shaped frame.

Accordingly, it is difficult to respond to requirements for further improvement in processing accuracy of a workpiece by merely adopting this countermeasure.

Meanwhile, as another countermeasure, Patent Literature 1 discloses a structure in which a mechanism configured to prevent occurrence of axis displacement between a fixed die and a movable die even when elastic deformation of opening occurs in a C-shaped frame is incorporated.

However, when such a mechanism is incorporated, there is a problem in which complication or an increase in cost of the structure of the press apparatus may become significant.

An aspect of the present invention is directed to providing a structure in which a C-shaped frame can be elastically deformed such that axis displacement occurring between a fixed die and a movable die is effectively minimized when pressing is performed on a workpiece between a fixed die and a movable die.

Solution to Problem (1) A frame structure of an aspect of the present invention includes a C-shaped frame having a front side that opens in a forward and rearward direction among the forward and rearward direction, a leftward and rightward direction and an upward and downward direction, which are perpendicular to each other; an upper action section supported by an upper front portion of the C-shaped frame; and a lower action section supported by a lower front portion of the C-shaped frame, wherein, when a reaction force is applied through the upper action section, the C-shaped frame is deformed such that a displacement of the upper action section in the forward and rearward direction, which occurs according to an elastic deformation of the C-shaped frame, is canceled out and such that a displacement of a pivotal movement about a leftward and rightward direction axis of the upper action section is canceled out.

(2) In the aspect of (1), according to the elastic deformation, the C-shaped frame may have a portion that displaces the upper action section forward and a portion that displaces the upper action section rearward.

(3) In addition, in the aspect of (1) or (2), according to the elastic deformation, the C-shaped frame may have a portion that pivots the upper action section to a one side about the leftward and rightward direction axis and a portion that pivots the upper action section to another side about the leftward and rightward direction axis.

(4) A frame structure of another aspect of the present invention includes a C-shaped frame that includes: a lower frame, an intermediate frame having a lower end portion coupled to the lower frame, a first upper frame which has a rear end portion coupled to an upper end portion of the intermediate frame and in which a front end portion thereof is disposed below the rear end portion thereof, and a second upper frame having a front end portion coupled to the front end portion of the first upper frame; an upper action section supported by the second upper frame; and a lower action section supported by the lower frame.

(5) In the aspect of (4), the lower action section may be supported movably with respect to the second upper frame in the upward and downward direction.

(6) In the aspect of (4) or (5), a pressing process of a workpiece may be performed between the upper action section and the lower action section.

(7) A processing apparatus of an aspect of the present invention includes the frame structure according to any one of the above-mentioned (1) to (6).

(8) A method of manufacturing components of an aspect of the present invention uses the frame structure according to any one of the above-mentioned (1) to (6).

(9) A method of manufacturing a rolling bearing of an aspect of the present invention uses the frame structure according to any one of the above-mentioned (1) to (6).

(10) A method of manufacturing a vehicle of an aspect of the present invention uses the frame structure according to any one of the above-mentioned (1) to (6).

(11) A method of manufacturing a machine of an aspect of the present invention uses the frame structure according to any one of the above-mentioned (1) to (6).

(12) A press apparatus of another aspect of the present invention includes a first point of action and a second point of action, to which a reaction force upon pressing are applied; and a frame that includes a continuous element that is continuous between the first point of action and the second point of action, the continuous element having a gap formed between the first point of action and the second point of action in a first direction, wherein the continuous element has a first position, a second position and a third position in sequence from the first point of action toward the second point of action, the third position and the second point of action are disposed between the first position and the second position in the first direction, the second point of action is disposed between the second position and the third position in a second direction crossing the first direction, and an angle between a line that connects the second position and the third position and a line that connects the third position and the second point of action varies during an elastic deformation of the frame upon a pressing process.

Advantageous Effects of Invention

According to the press apparatus of the present invention, it is possible to electrically deform the C-shaped frame such that axis displacement occurring between a fixed die and a movable die is effectively minimized when pressing is performed on a workpiece between the fixed die and the movable die.

DESCRIPTION OF EMBODIMENTS

First Embodiment

Figure 1:
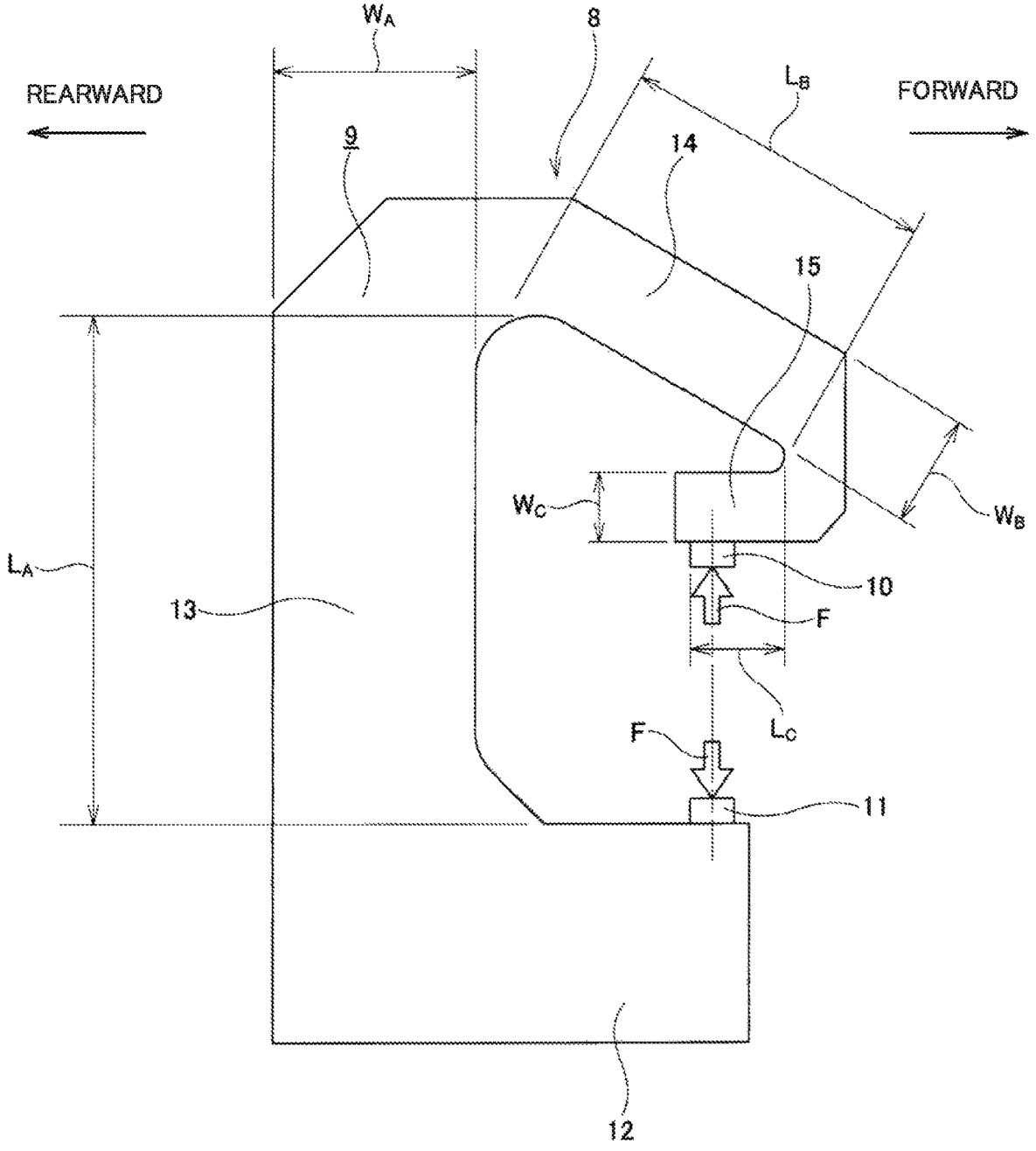
FIG. 1 is a schematic side view of a press apparatus according to a first embodiment of the present invention.

A first embodiment of the present invention will be described with reference to FIGS. 1 to 3.

A press apparatus 8 of the example is used while being placed on a floor surface of a factory or the like, and includes a C-shaped frame 9, a fixed die (an upper action section, a second point of action) 10 and a movable die (a lower action section, a first point of action) 11.

The C-shaped frame 9 is configured by combining a lower frame 12, an intermediate frame 13, a first upper frame 14 and a second upper frame 15, which are formed of a metal, in substantially a C shape in which a front side in the forward and rearward direction and both sides in the leftward and rightward direction are open.

Specifically, the lower frame 12 is placed on a floor surface of a factory or the like, and disposed in the forward and rearward direction. In addition, the intermediate frame 13 is disposed in the upward and downward direction, and has a lower end portion that is coupled to a rear end portion of the lower frame 12. In addition, the first upper frame 14 is disposed in the forward and rearward direction, and has a rear end portion that is coupled to an upper end portion of the intermediate frame 13 and a front end portion disposed below the rear end portion. In other words, the first upper frame 14 is inclined from the rear end portion thereof in a direction in which it is located more downward as it goes closer to the front end portion thereof.

In addition, the second upper frame 15 is disposed in the forward and rearward direction, and has a front end portion that is coupled to a front end portion of the first upper frame 14. In the case of the example, a length of the second upper frame 15 is sufficiently shorter than that of the first upper frame 14.

Further, the above-mentioned C-shaped frame 9 may be integrally formed as a whole, in addition to being able to be configured by coupling and fixing a plurality of parts to each other.

The fixed die 10 is supported by and fixed to a lower surface of the rear end portion of the second upper frame 15.

The movable die 11 is supported movably with respect to the front end portion of the lower frame 12 in the upward and downward direction while being disposed below the fixed die 10. For this reason, specifically, the movable die 11 is supported movably in the upward and downward direction by a hydraulic or electrically-operated cylinder (not shown) assembled on the lower frame 12. In addition, in this state, central axes of the fixed die 10 and the movable die 11 are disposed on the same virtual line extending in a vertical direction.

When pressing of the workpiece is performed using the press apparatus 8 of the example having the above-mentioned configuration, for example, the movable die 11 is moved upward toward the fixed die 10 in a state in which the movable die 11 is retracted downward from the fixed die 10 and the workpiece is set on the fixed die 10 or the movable die 11. Accordingly, predetermined pressing such as shearing, bending, drawing, forging, or the like, is performed with respect to the workpiece between the fixed die 10 and the movable die 11.

When pressing of the workpiece is performed using the press apparatus 8 as described above, the processing reaction force F from the workpiece is applied to the C-shaped frame 9 via the fixed die 10 and the movable die 11 (and the cylinder). Accordingly, for example, elastic deformation of opening as shown by a two-dot chain line in FIG. 2 occurs in the C-shaped frame 9.

Figure 2:
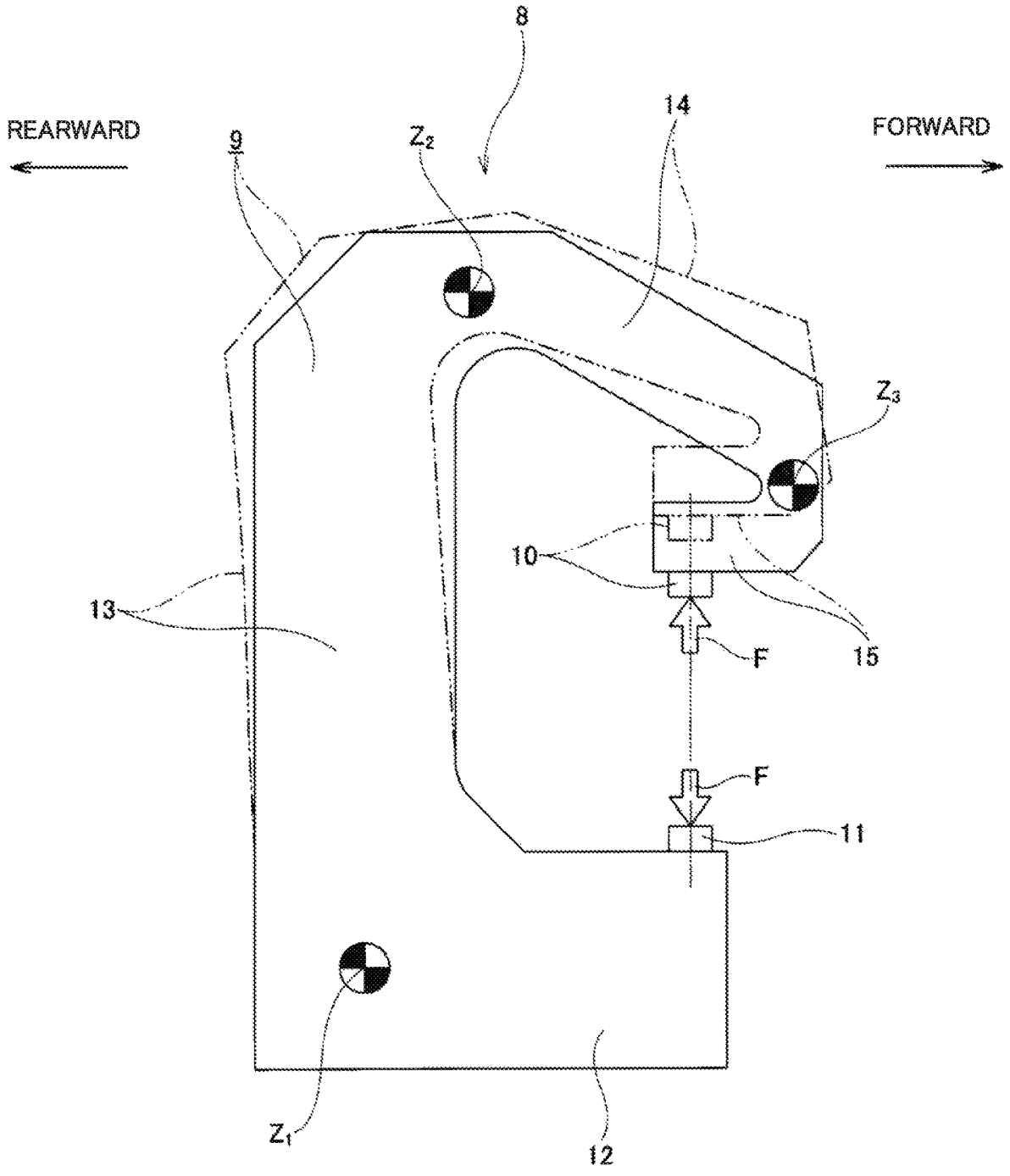
FIG. 2 is a schematic side view showing the press apparatus according to the first embodiment of the present invention in a state before and after a C-shaped frame is elastically deformed by a processing reaction force.

Specifically, in FIG. 2, the C-shaped frame 9 is elastically deformed such that the intermediate frame 13 is pivoted, i.e., tilted counterclockwise (a + direction) to one side about an axis $Z_1$ in the leftward and rightward direction with respect to the lower frame 12, the first upper frame 14 is pivoted, i.e., tilted counterclockwise (the + direction) about an axis $Z_2$ in the leftward and rightward direction with respect to the intermediate frame 13, and the second upper frame 15 is pivoted, i.e., tilted clockwise (a − direction) to the other side about an axis $Z_3$ in the leftward and rightward direction with respect to the first upper frame 14. Further, since the processing reaction force F applied to the lower frame 12 is supported by the floor surface, an attitude of the lower frame 12 does not vary.

Figure 3:
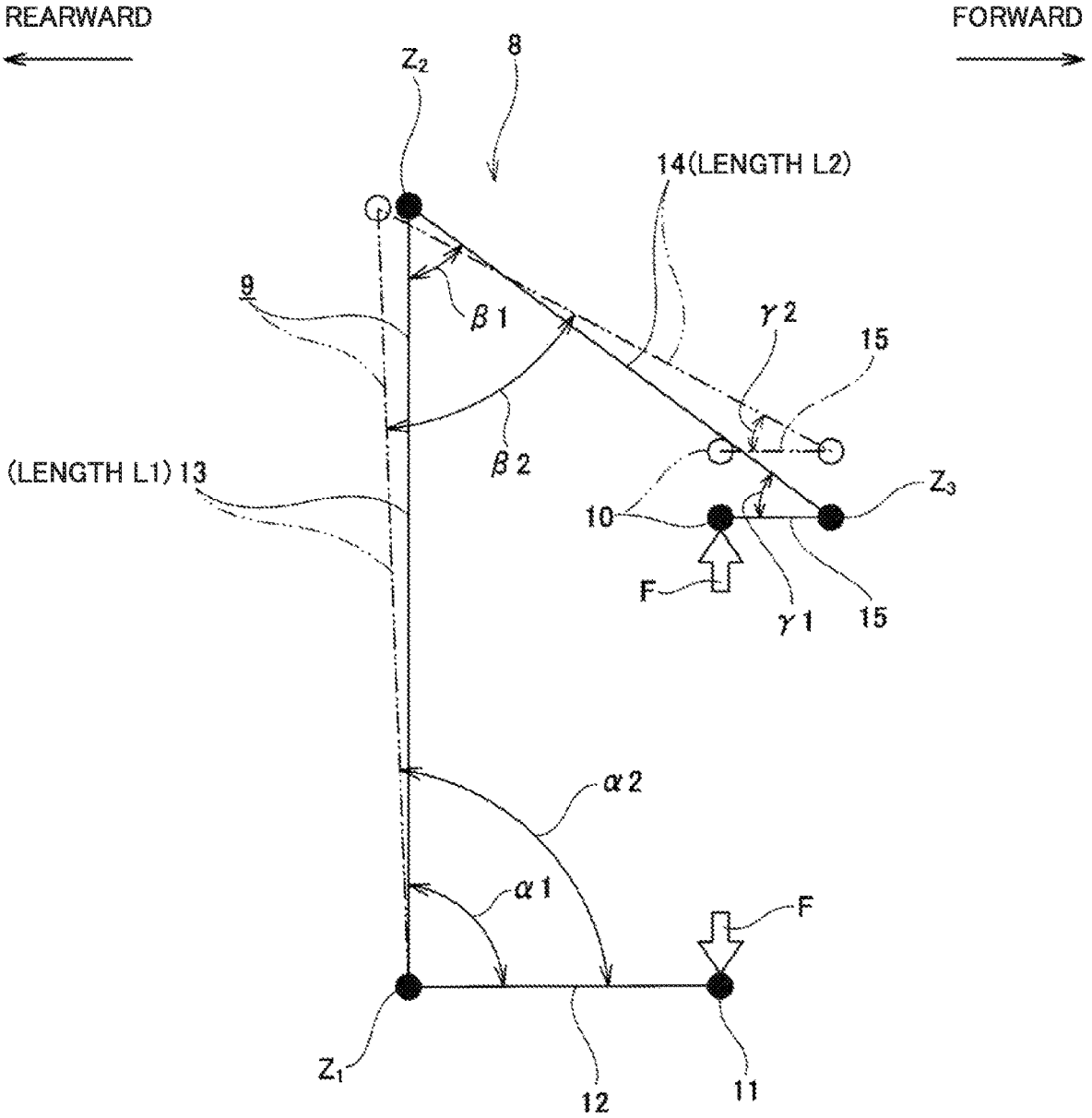
FIG. 3 is a side view showing a skeleton model of the C-shaped frame according to the first embodiment of the present invention in a state before and after the C-shaped frame is elastically deformed by a processing reaction force.
Figure 4:
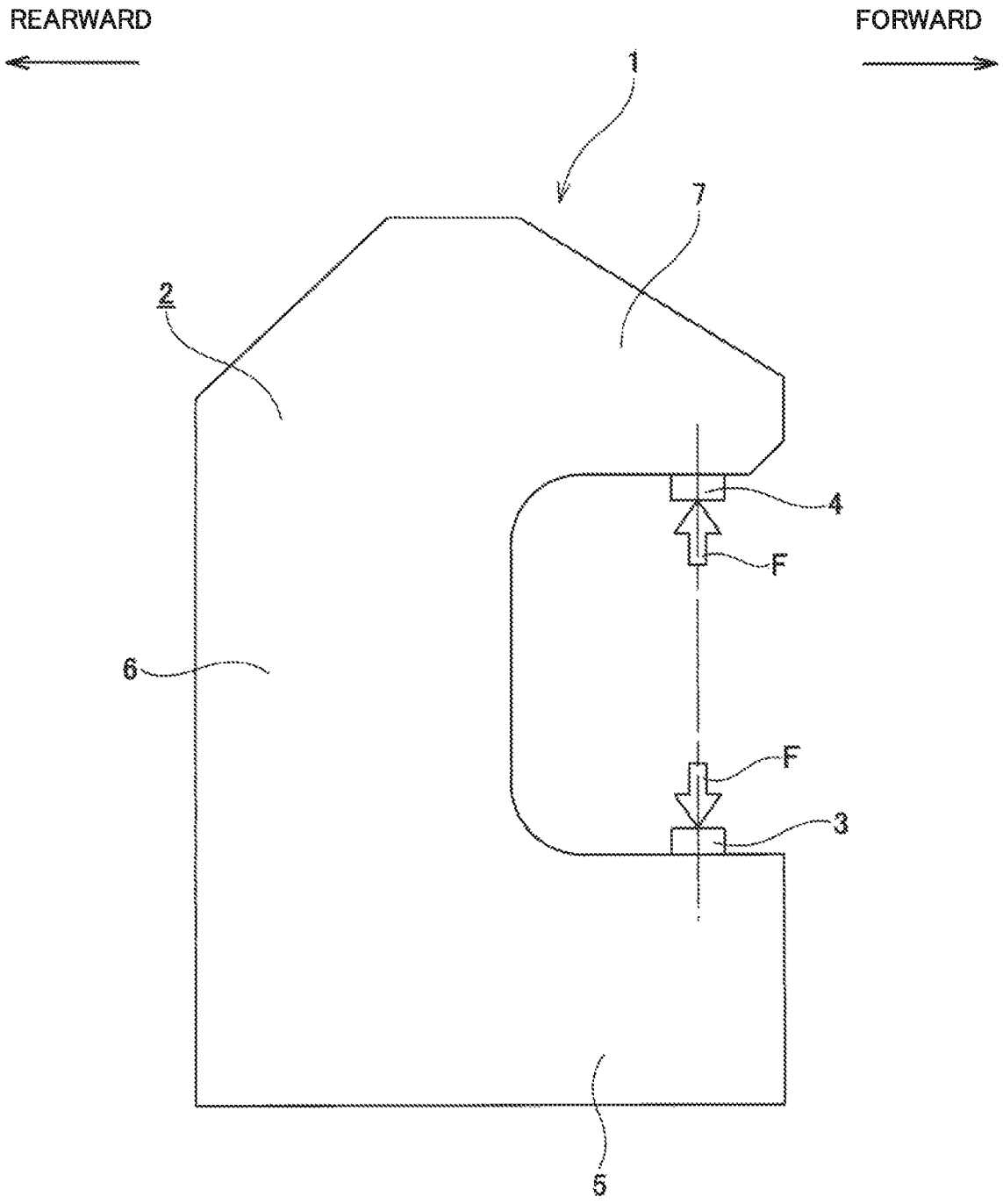
FIG. 4 PRIOR ART
FIG. 4 is a schematic side view showing a press apparatus having a conventional structure.
Figure 5:
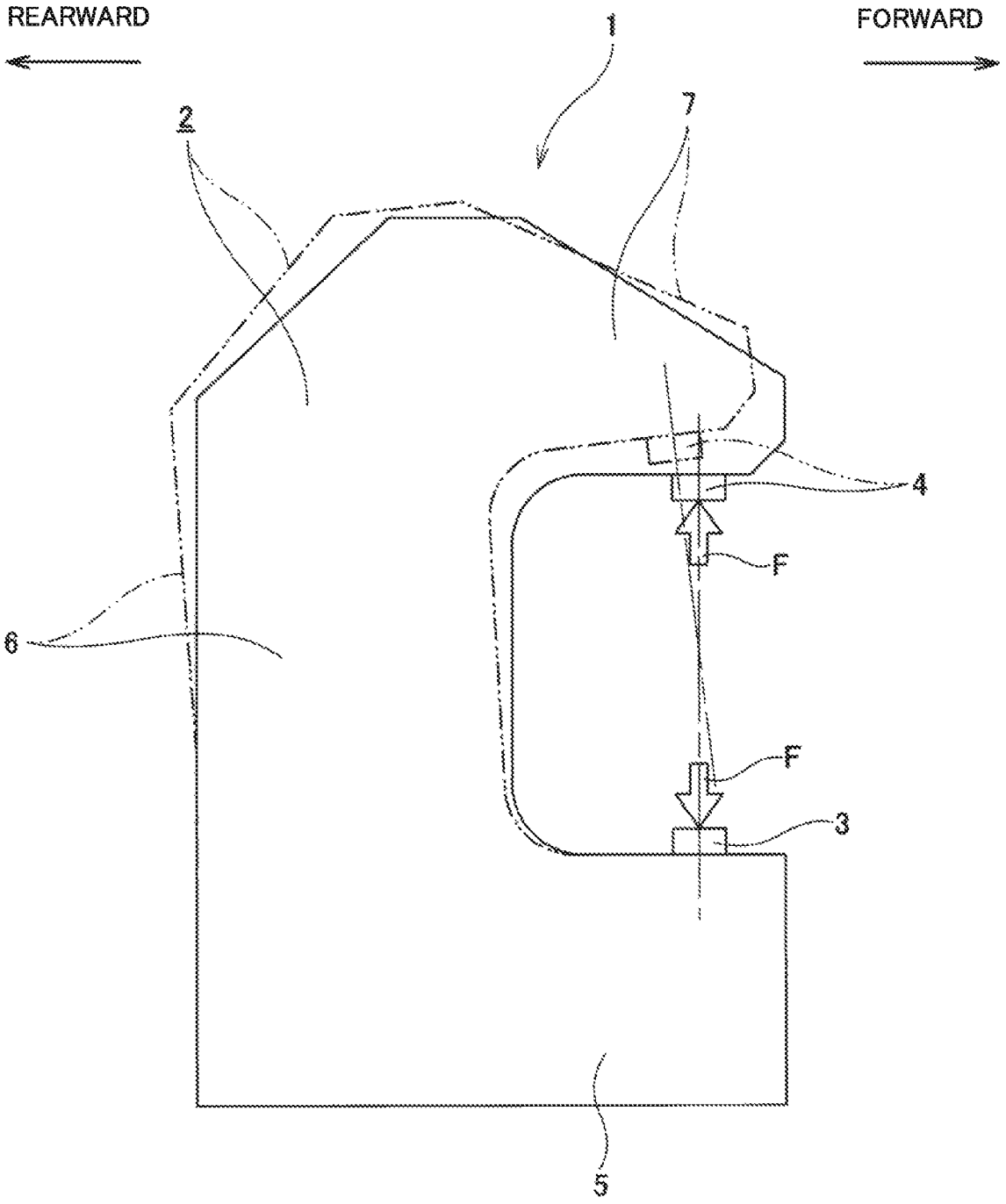
FIG. 5 PRIOR ART
FIG. 5 is a schematic side view showing the press apparatus having a conventional structure in a state before and after a C-shaped frame is elastically deformed by a processing reaction force.

FIG. 3 schematically shows a variation in attitude of the C-shaped frame 9 at this time, i.e., shows a skeleton model in which elastic bending deformation occurring in each of the frames 13 to 15 is ignored. Also in FIG. 3, like FIG. 2, the C-shaped frame 9 in a state before elastic deformation is shown by a solid line and the C-shaped frame 9 in a state after elastic deformation is shown by a two-dot chain line.

The frame 9 has a first point of action (11) corresponding to the movable die (the lower action section) 11, a second point of action (10) corresponding to the fixed die (the upper action section) 10. The first point of action (11) and the second point of action (10) are disposed to face each other, and a reaction force upon processing (for example, pressing) is substantially simultaneously applied to the first point of action (11) and the second point of action (10). In at least a first direction (for example, in the upward and downward direction), a gap is formed between the first point of action (11) and the second point of action (10). The frame 9 has a continuous element that continues between the first point of action (11) and the second point of action (10), and the continuous element extends at least the first direction and a second direction (for example, the upward and downward direction) crossing the first direction. The continuous element has a first element (12) corresponding to the lower frame 12, a second element (13) corresponding to the intermediate frame 13, a third element (14) corresponding to the upper frame 14, and a fourth element (15) corresponding to the upper frame 15. The continuous element of the frame 9 has a first position $Z_1$, a second position $Z_2$ and a third position $Z_3$ in sequence from the first point of action (11) toward the second point of action (10). In the continuous element of the frame 9, the first position $Z_1$ is disposed between the first element (12) and the second element (13). The second position $Z_2$ is disposed between the second element (13) and the third element (14). The third position $Z_3$ is disposed between the third element (14) and the fourth element (15). In other words, in the continuous element of the frame 9, the first element (12) is disposed between the first point of action (11) and the first position $Z_1$, the second element (13) is disposed between the first position $Z_1$ and the second position $Z_2$, the third element (14) is disposed between the second position $Z_2$ and the third position $Z_3$, and the fourth element (15) is disposed between the third position $Z_3$ and the second point of action (10). In the first direction, the third position $Z_3$ and the second point of action (10) are disposed between the first position $Z_1$ and the second position $Z_2$. In the second direction crossing the first direction, the second point of action (10) is disposed between the second position $Z_2$ and the third position $Z_3$. In an example, the second position $Z_2$, the third position $Z_3$ and the second point of action (10) are disposed above the first point of action (11) and the first position $Z_1$. The second position $Z_2$ is disposed above the third position $Z_3$ and the second point of action (10). In the forward and rearward direction, the second point of action (10) is disposed between the second position $Z_2$ and the third position $Z_3$. In the entire elastic deformation of the frame 9 upon processing (for example, pressing), an angle ($\gamma$) between a line that connects the second position $Z_2$ and the third position $Z_3$ and a line that connects the third position $Z_3$ and the second point of action (11) varies ($\gamma 1 \rightarrow \gamma 2$).

As shown in FIG. 3, when the intermediate frame 13 is tilted counterclockwise (the + direction) with respect to the lower frame 12 by the processing reaction force F, a narrow angle between the lower frame 12 and the intermediate frame 13 varies from al to $\alpha 2$, i.e., increased by $\alpha 2 - \alpha 1$. In addition, when the first upper frame 14 is similarly tilted counterclockwise (the + direction) with respect to the intermediate frame 13, a narrow angle between the intermediate frame 13 and the first upper frame 14 varies from $\beta 1$ to $\beta 2$, i.e., increased by $\beta 2 - \beta 1$. In addition, when the second upper frame 15 is similarly tilted clockwise (the − direction) with respect to the first upper frame 14, a narrow angle between the first upper frame 14 and the second upper frame 15 varies from $\gamma 1$ to $\gamma 2$, i.e., reduced by $\gamma 1 - \gamma 2$.

In addition, in the case of an example, when the intermediate frame 13 is tilted counterclockwise (the + direction) with respect to the lower frame 12 as described above, a central axis of the fixed die 10 is also tilted counterclockwise (the + direction) by the same angle ($\alpha 2 - \alpha 1$). In addition, when the first upper frame 14 is tilted counterclockwise (the + direction) with respect to the intermediate frame 13 as described above, a central axis of the fixed die 10 is also tilted counterclockwise (the + direction) by the same angle ($\beta 2-\beta 1$). In addition, when the second upper frame 15 is tilted clockwise (the − direction) with respect to the first upper frame 14 as described above, a central axis of the fixed die 10 is also tilted clockwise (the − direction) by the same angle ($\gamma 1-\gamma 2$).

That is, in the case of the example, since a counterclockwise (the + direction) tilting angle $\{(\alpha 2-\alpha 1)+(\beta 2-\beta 1)\}$ of the central axis of the fixed die 10 occurring due to the counterclockwise (the + direction) tilting of the intermediate frame 13 and the first upper frame 14 and a clockwise (the − direction) tilting angle ($\gamma 1-\gamma 2$) of the central axis of the fixed die 10 occurring due to the clockwise (the − direction) tilting of the second upper frame 15 have substantially the same size and invert signs, the angles act to cancel each other. For this reason, in the case of the example, inclination of the central axes of the fixed die 10 and the movable die 11 occurring when the pressing is performed on the workpiece is effectively inhibited.

In addition, in the case of the example, when the intermediate frame 13 is tilted counterclockwise (the + direction) with respect to the lower frame 12 as described above, the upper end portion of the intermediate frame 13 is displaced rearward by a distance $\{L1 \sin(\alpha 2-\alpha 1)\}$ in accordance with a length {L1 (FIG. 3)} and a tilting angle ($\alpha 2-\alpha 1$) of the intermediate frame 13 in the forward and rearward direction. Then, accordingly, the fixed die 10 is also displaced rearward by the same distance.

In addition, in the case of the example, since the front end portion of the first upper frame 14 is disposed below the rear end portion thereof, when the first upper frame 14 is tilted counterclockwise (the + direction) with respect to the intermediate frame 13 as described above, the front end portion of the first upper frame 14 is displaced forward by a distance $[L2\{\cos(\pi-\alpha 2-\beta 2)-\cos(\pi-\alpha 1-\beta 1)\}\{\approx L2 (\cos \gamma 2-\cos \gamma 1)\}]$ in accordance with a length {L2 (FIG. 3)}, a tilting angle ($\beta 2-\beta 1$), and so on, of the first upper frame 14 in the forward and rearward direction. Then, accordingly, the fixed die 10 is also displaced forward by the same distance. Further, in the case of the example, since the length of the second upper frame 15 is sufficiently shorter than the length of the first upper frame 14 and the second upper frame 15 is disposed to be substantially parallel to the forward and rearward direction, even when the second upper frame 15 is tilted clockwise (the − direction) with respect to the first upper frame 14 as described above, the fixed die 10 has an extremely small displacement in the forward and rearward direction.

That is, in the case of the example, since rearward displacement of the fixed die 10 occurring due to the counterclockwise (the + direction) tilting of the intermediate frame 13 and forward displacement of the fixed die 10 occurring due to the counterclockwise (the + direction) tilting of the first upper frame 14 have substantially the same size and invert signs, the displacements act to cancel each other. For this reason, in the case of the example, a relative displacement amount in the forward and rearward direction between the fixed die 10 and the movable die 11 occurring when pressing is performed on the workpiece is effectively minimized.

As described above, in the case of the example, axis displacement (inclination of the central axes of the fixed die 10 and the movable die 11, and relative displacement in the forward and rearward direction of the fixed die 10 and the movable die 11) between the fixed die 10 and the movable die 11 occurring when pressing is performed on the workpiece is effectively minimized.

For example, in the case of the example, when lengths or a balance between rigidities of parts that constitute the C-shaped frame 9 are adjusted, as shown in FIG. 2, when pressing is performed on the workpiece, it is also possible to prevent almost entire axis displacement between the fixed die 10 and the movable die 11. In other words, in the case of the example, according to an increase in elastic deformation amount of the C-shaped frame 9 due to an increase in processing reaction force, it is possible to prevent axis displacement between the fixed die 10 and the movable die 11 while allowing upward displacement of the fixed die 10. Accordingly, in the case of the example, improvement of processing accuracy of the workpiece and extension of lifespan of the fixed die 10 and the movable die 11 can be achieved.

Further, in the above-mentioned embodiment, a configuration in which the movable die 11 is supported movably with respect to the lower frame 12 in the upward and downward direction while the fixed die 10 is supported by and fixed to the second upper frame 15 is employed. However, when the present invention is realized, a configuration in which the movable die is supported movably with respect to the second upper frame in the upward and downward direction while the fixed die is supported by the lower frame can also be employed.

In addition, the example in the above-mentioned embodiment has been described using the configuration in which the C-shaped frame 9 and the press apparatus 8 are installed in the upward and downward direction. However, the direction in which the C-shaped frame 9 and the press apparatus 8 are installed is not limited to the upward and downward direction and the C-shaped frame 9 and the press apparatus 8 may be installed in an arbitrary direction.

Further, the frame structure of the above-mentioned embodiment may be used in a processing apparatus including, for example, a frictional agitation joining apparatus disclosed in Japanese Unexamined Patent Application, First Publication No. 2014-18850. In addition, the frame structure of the above-mentioned embodiment may be used to manufacture components including, for example, mechanical components, electro-mechanical components, and so on. In particular, the frame structure of the above-mentioned embodiment may be used to manufacture bearing parts. For example, the frame structure of the above-mentioned embodiment may be used to manufacture bearing parts including a rolling bearing disclosed in Japanese Unexamined Patent Application, First Publication No. 2014-101896.

In addition, for example, the frame structure of the above-mentioned embodiment may be used for manufacture of a vehicle, a machine, or the like. In particular, the frame structure of the above-mentioned embodiment may be used for manufacturing a vehicle or a machine including a rolling bearing. Further, in a vehicle, a machine, or the like, that is a manufacturing target, regardless of a type of power, a power for operating the vehicle, the machine, or the like, may be other than manpower, or may be manpower.

Example

When the present invention is performed, in the structure of the embodiment shown in FIG. 1, for example, a material of the C-shaped frame 9 may be SS400 (JIS G 3101, rolled steel for a general structure), a thickness dimension T in the leftward and rightward direction of the C-shaped frame 9 is 35 mm, a length dimension $L_A$ in FIG. 1 of the intermediate frame 13 is 370 mm, a width dimension $W_A$ in FIG. 1 of the intermediate frame 13 is 140 mm, a length dimension $L_B$ in FIG. 1 of the first upper frame 14 is 130 mm, a width dimension $W_B$ in FIG. 1 of the first upper frame 14 is 51 mm, a length dimension $L_C$ in FIG. 1 of the second upper frame 15 is 70 mm, a width dimension $W_C$ in FIG. 1 of the second upper frame 15 is 15 mm, and a pressing force (a processing reaction force F) applied to the workpiece may be, for example, 4000 N.

Further, the material and the thickness dimension T in the leftward and rightward direction of the C-shaped frame 9 is independent from the axis displacement between the fixed die 10 and the movable die 11 occurring when a pressing force is applied to a workpiece, however, they influence a relative displacement amount in an axial direction (a pressing force direction) between the fixed die 10 and the movable die 11 when a pressing force is applied to a workpiece.

When the above-mentioned configuration is employed, axis displacement between the fixed die 10 and the movable die 11 occurring when a pressing force of, for example, 4000 N is applied to a workpiece is extremely small, specifically, ignorable in general pressing.

REFERENCE SIGNS LIST

1 Press apparatus
2 C-shaped frame
3 Fixed die
4 Movable die
5 Lower frame
6 Intermediate frame
7 Upper frame
8 Press apparatus
9 C-shaped frame
10 Fixed die
11 Movable die
12 Lower frame
13 Intermediate frame
14 First upper frame
15 Second upper frame

The invention claimed is:

1. A frame structure comprising:

a C-shaped frame that has a front side that opens in a forward and rearward direction among the forward and rearward direction, a leftward and rightward direction and an upward and downward direction, which are perpendicular to each other, and that includes a lower frame, an intermediate frame having a lower end portion coupled to the lower frame, a first upper frame which has a rear end portion coupled to an upper end portion of the intermediate frame and in which a front end portion thereof is disposed below the rear end portion thereof, and a second upper frame having a front end portion coupled to the front end portion of the first upper frame;

an upper action section supported by the second upper frame of the C-shaped frame; and a lower action section supported by the lower frame of the C-shaped frame, wherein, when a reaction force is applied through the upper action section, the C-shaped frame itself is elastically deformed such that a displacement of the upper action section in the forward and rearward direction and a displacement of a pivotal movement about a leftward and rightward direction axis of the upper action section, which occurs according to an elastic deformation of the C-shaped frame, is canceled out by an increase of an angle between the intermediate frame and the lower frame and a decrease of an angle between the first upper frame and the second upper frame.

2. The frame structure according to claim 1, wherein the first upper frame is extended away from the intermediate frame in a direction from the rear end portion of the first upper frame to the front end portion of the first upper frame, wherein the second upper frame is extended towards the intermediate frame in a direction from the front end portion of the second upper frame and the front end portion of the first upper frame to a second end portion of the second upper frame, and wherein the second end portion of the second upper frame is opposite to the front end portion of the second upper frame.

3. A frame structure comprising:

a C-shaped frame that has a front side that opens in a forward and rearward direction among the forward and rearward direction, a leftward and rightward direction and an upward and downward direction, which are perpendicular to each other, and that includes a lower frame, an intermediate frame having a lower end portion coupled to the lower frame, a first upper frame which has a rear end portion coupled to an upper end portion of the intermediate frame and in which a front end portion thereof is disposed below the rear end portion thereof, and a second upper frame having a front end portion coupled to the front end portion of the first upper frame;

an upper action section supported by the second upper frame of the C-shaped frame; and a lower action section supported by the lower frame of the C-shaped frame, wherein, when a reaction force is applied through the upper action section, the C-shaped frame itself is elastically deformed, and wherein according to the elastic deformation, the intermediate frame and the first upper frame of the C-shaped frame pivots to a first rotational direction about a leftward and rightward direction axis and the second upper frame of the C-shaped frame pivots to a second rotational direction, which is a direction opposite to the first rotational direction, about the leftward and rightward direction axis.

4. The frame structure according to claim 3, wherein the first upper frame is extended away from the intermediate frame in a direction from the rear end portion of the first upper frame to the front end portion of the first upper frame, wherein the second upper frame is extended towards the intermediate frame in a direction from the front end portion of the second upper frame and the front end portion of the first upper frame to a second end portion of the second upper frame, and wherein the second end portion of the second upper frame is opposite to the front end portion of the second upper frame.

5. The frame structure according to claim 1, wherein, according to the elastic deformation, the C-shaped frame has a portion that displaces the upper action section forward and a portion that displaces the upper action section rearward.

6. The frame structure according to claim 3, wherein, according to the elastic deformation, the C-shaped frame has a portion that displaces the upper action section forward and a portion that displaces the upper action section rearward.

7. The frame structure according to claim 1, wherein, according to the elastic deformation, the intermediate frame and the first upper frame of the C-shaped frame pivots to a first rotational direction about the leftward and rightward direction axis and the second upper frame of the C-shaped frame pivots to a second rotational direction, which is a direction opposite to the first rotational direction, about the leftward and rightward direction axis.

8. A frame structure comprising:

a C-shaped frame that includes: a lower frame, an intermediate frame having a lower end portion coupled to the lower frame, a first upper frame which has a rear end portion coupled to an upper end portion of the intermediate frame and in which a front end portion thereof is disposed below the rear end portion thereof, and a second upper frame having a front end portion coupled to the front end portion of the first upper frame;

an upper action section supported by the second upper frame; and a lower action section supported by the lower frame, wherein a rear end portion of the second upper frame is exposed to a space between the intermediate frame and the second upper frame, and when a reaction force is applied through the upper action section, the intermediate frame and the first upper frame pivots in a first rotational direction about a leftward and rightward direction axis, and the second upper frame pivots in second rotational direction, which is a direction opposite to the first rotational direction, about the leftward and rightward direction axis.

9. The frame structure according to claim 8, wherein the first upper frame is extended away from the intermediate frame in a direction from the rear end portion of the first upper frame to the front end portion of the first upper frame, wherein the second upper frame is extended towards the intermediate frame in a direction from the front end portion of the second upper frame and the front end portion of the first upper frame to a second end portion of the second upper frame, and wherein the second end portion of the second upper frame is opposite to the front end portion of the second upper frame.

10. A frame structure comprising:

a C-shaped frame that includes: a lower frame, an intermediate frame having a lower end portion coupled to the lower frame, a first upper frame which has a rear end portion coupled to an upper end portion of the intermediate frame and in which a front end portion thereof is disposed below the rear end portion thereof, and a second upper frame having a front end portion coupled to the front end portion of the first upper frame;

an upper action section supported by the second upper frame; and a lower action section supported by the lower frame, wherein a rear end portion of the second upper frame is exposed to a space between the intermediate frame and the second upper frame, wherein, in an elastic deformation of the C-shaped frame when a reaction force is applied through the upper action section, an angle between the intermediate frame and the lower frame is increased and an angle between the first upper frame and the second upper frame is decreased.

11. The frame structure according to claim 10, wherein the first upper frame is extended away from the intermediate frame in a direction from the rear end portion of the first upper frame to the front end portion of the first upper frame, wherein the second upper frame is extended towards the intermediate frame in a direction from the front end portion of the second upper frame and the front end portion of the first upper frame to a second end portion of the second upper frame, and wherein the second end portion of the second upper frame is opposite to the front end portion of the second upper frame.

12. The frame structure according to claim 8, wherein the lower action section is supported movably with respect to the second upper frame in the upward and downward direction.

13. The frame structure according to claim 8, wherein the first upper frame is inclined downward so that a portion of the first upper frame is located more downward as it goes closer to the front end portion thereof from the rear end portion thereof.

14. The frame structure according to claim 8, wherein a length of the second upper frame is shorter than a length of the first upper frame.

15. The frame structure according to claim 8, wherein the upper action section is supported by and fixed to a lower surface of the rear end portion of the second upper frame.

16. The frame structure according to claim 8, wherein, when a reaction force is applied through the upper action section, the intermediate frame is inclined so that an angle between the intermediate frame and the lower frame is increased.

17. The frame structure according to claim 8, wherein a pressing process of a workpiece is performed between the upper action section and the lower action section.

18. The frame structure according to claim 10, wherein the lower action section is supported movably with respect to the second upper frame in the upward and downward direction.

19. The frame structure according to claim 10, wherein the first upper frame is inclined downward so that a portion of the first upper frame is located more downward as it goes closer to the front end portion thereof from the rear end portion thereof.

20. The frame structure according to claim 10, wherein a length of the second upper frame is shorter than a length of the first upper frame.

21. The frame structure according to claim 10, wherein the upper action section is supported by and fixed to a lower surface of the rear end portion of the second upper frame.

22. The frame structure according to claim 10, wherein a pressing process of a workpiece is performed between the upper action section and the lower action section.

23. A processing apparatus including the frame structure according to claim 1.

24. A method of manufacturing components using the frame structure according to claim 1.

25. A processing apparatus including the frame structure according to claim 3.

26. A method of manufacturing components using the frame structure according to claim 3.

27. A processing apparatus including the frame structure according to claim 8.

28. A method of manufacturing components using the frame structure according to claim 8.

29. A processing apparatus including the frame structure according to claim 10.

30. A method of manufacturing components using the frame structure according to claim 10.

31. A press apparatus comprising:

a first point of action and a second point of action, to which a reaction force upon pressing are applied; and a frame that includes a continuous element that is continuous between the first point of action and the second point of action, the continuous element having a gap formed between the first point of action and the second point of action in a first direction, wherein the continuous element has a first position, a second position and a third position in sequence from the first point of action toward the second point of action, the third position and the second point of action are disposed between the first position and the second position in the first direction, the second point of action is disposed between the second position and the third position in a second direction crossing the first direction, and during the elastic deformation of the frame upon a pressing process, an angle between a line that connects the first point of action and the first position and a line that connects the first position and the second point of action increases, and an angle between a line that connects the second position and the third position and a line that connects the third position and the second point of action decreases.

* * * * *